US011452892B2

(12) United States Patent
Kelly et al.

(10) Patent No.: US 11,452,892 B2
(45) Date of Patent: Sep. 27, 2022

(54) MOBILE FALL RESTRAINT APPARATUS

(71) Applicant: Kelly Steel LLC, Carrollton, MO (US)

(72) Inventors: Justin Kelly, Carrollton, MO (US); Mindy Kelly, Carrollton, MO (US)

(73) Assignee: Kelly Steel LLC, Carrollton, MO (US)

( * ) Notice: Subject to any disclaimer, the term of this patent is extended or adjusted under 35 U.S.C. 154(b) by 0 days.

(21) Appl. No.: 15/931,763

(22) Filed: May 14, 2020

(65) Prior Publication Data

US 2020/0398089 A1 Dec. 24, 2020

Related U.S. Application Data

(60) Provisional application No. 62/862,798, filed on Jun. 18, 2019.

(51) Int. Cl.
*A62B 35/00* (2006.01)

(52) U.S. Cl.
CPC ..... *A62B 35/0068* (2013.01)

(58) Field of Classification Search
CPC combination set(s) only.
See application file for complete search history.

(56) References Cited

U.S. PATENT DOCUMENTS 4,607,724 A 8/1986 Hillberg
4,817,758 A 4/1989 Gilmore
4,819,767 A * 4/1989 Laird ..... B62B 5/04 188/196 M
5,065,838 A 11/1991 Finley
5,906,383 A * 5/1999 Cortes ..... B62B 5/0438 280/47.371
6,029,407 A * 2/2000 Schillero, Jr. ..... E04G 21/26 248/351
6,227,553 B1 * 5/2001 Palmer ..... A62B 35/0068 280/47.18
6,315,648 B1 * 11/2001 Neer ..... B24C 3/062 451/92
6,745,868 B2 * 6/2004 Cheval ..... A62B 35/0056 182/3
6,827,364 B1 * 12/2004 Martin ..... B62B 3/027 280/641
7,032,710 B2 * 4/2006 Anderson ..... A62B 35/0068 182/16
8,100,228 B2 1/2012 Hamilton et al.
8,240,431 B2 * 8/2012 Smith ..... A62B 35/04 182/3
8,292,242 B2 * 10/2012 Thompson ..... B25B 11/002 248/206.5
8,544,830 B2 * 10/2013 Sladojevic ..... B28B 7/0017 269/8

(Continued)

FOREIGN PATENT DOCUMENTS

WO WO 93/012838 7/1993
WO WO 03/080186 10/2003
WO WO 200/028326 4/2004

*Primary Examiner* — Monica E Millner
(74) *Attorney, Agent, or Firm* — Avek IP, LLC

(57) ABSTRACT

The present invention includes a relatively light weight wheeled cart and one or more magnets to releasably secure the cart to the roof. The rolling apparatus is equipped with adjustable, magnetic anchors, and include large rubber tires for easy movement. Extra magnets may be added to support more workers.

16 Claims, 3 Drawing Sheets

(56) References Cited

U.S. PATENT DOCUMENTS

| | | | | |
|---|---|---|---|---|
| 8,985,273 | B2 * | 3/2015 | Terry | E04G 21/3238 182/4 |
| 9,186,529 | B2 | 11/2015 | Correia | |
| 9,410,331 | B2 * | 8/2016 | King | E04G 5/04 |
| 10,183,185 | B2 | 1/2019 | Carroccia et al. | |
| 10,456,608 | B2 * | 10/2019 | Johanneck | A62B 35/0068 |
| 10,926,115 | B2 * | 2/2021 | Ettling | B64F 5/40 |
| 2004/0055818 | A1 | 3/2004 | Fulton et al. | |
| 2005/0116131 | A1 * | 6/2005 | Samuel | B28B 7/0017 248/357 |
| 2007/0289811 | A1 | 12/2007 | Smith | |
| 2009/0321184 | A1 | 12/2009 | Hamilton | |
| 2011/0303484 | A1 | 12/2011 | Stoffels et al. | |
| 2013/0264442 | A1 | 10/2013 | Correia | |
| 2016/0332011 | A1 | 11/2016 | MacKarvich | |
| 2021/0016114 | A1 * | 1/2021 | Franke | A62B 35/0068 |

* cited by examiner

MOBILE FALL RESTRAINT APPARATUS

FIELD

The present invention relates to an apparatus for restraining a fall and, more particularly, to a mobile apparatus for placement on a roof or other raised structure and uses magnets to releasably secure the apparatus to the structure.

BACKGROUND

Fall restraint systems for protecting workers from falling from a raised surface are generally known in the art. These systems include, for example, an anchor secured to a roof surface, and wheeled carts with an arrestor arm assembly with a gripper plate that jams into the surface of the roof when activated by a falling worker. Problems with these prior art fall restraint systems include physically attaching the system to the roof surface which requires a suitable anchor point and requires time each time the system has to be moved, or with respect to the mobile wheeled carts, the cart is very heavy and physically damages the roof in the event of a fall.

The most common system used are screw down, butterfly-style anchors. While some roofing contractors choose claw-type carts, much of the work done on a roof can be accomplished behind perimeter cables or leading-edge barricade systems. There is a need for a more efficient method for those outside of the controlled deck zone or "CDZ," and any other worker performing tasks outside the barricaded safe zones. The current systems are inefficient. In metal decking operations workers can spend just as much time maintaining 100% tie off rules as they do on their actual tasks.

SUMMARY

The present invention addresses the need for a more efficient method for workers outside of the controlled decking zone or "CDZ," and any other worker performing tasks outside the barricaded safe zones. The present invention includes a relatively light weight wheeled cart and one or more magnets to releasably secure the cart to the roof. The rolling system equipped with adjustable and magnetic anchors, may include large rubber tires for easy movement. Extra magnets may be added to support more workers.

A cart style anchor system may be constructed with adjustable magnetic anchors. The height of the magnets may be adjusted over steel support members joints or beams. Shims may be placed in the lows of the decking to keep pressure from crushing the decking. The cart may have "eyes" or attachment points for lanyards or retractable lifelines.

DETAILED DESCRIPTION

While certain forms and embodiments of the invention have been illustrated and described herein, the present invention is not to be limited to the specific forms or arrangement of parts described and shown, and that the various features described may be combined in ways other than those specifically described without departing from the scope of the present invention.

Figure 1:
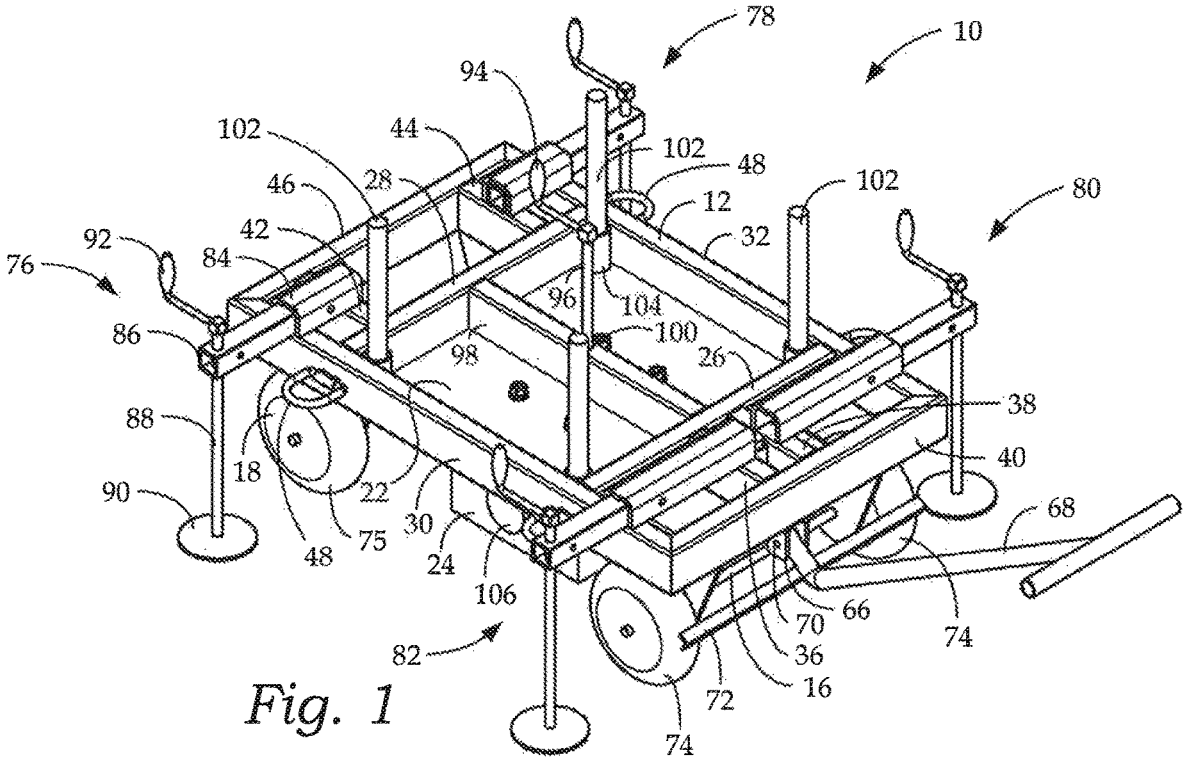
FIG. 1 is a top perspective view of the fall restraint system of the present invention.
Figure 2:
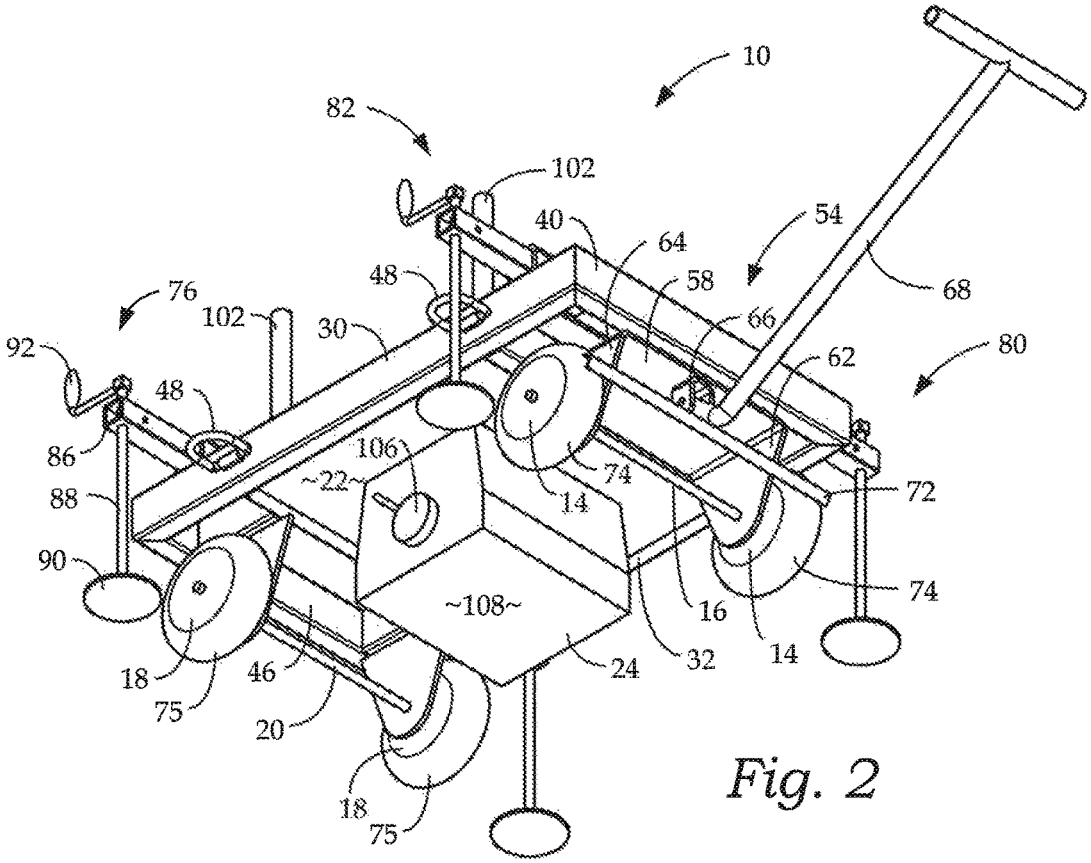
FIG. 2 is a bottom perspective view of the fall restraint system of FIG. 1.
Figure 3:
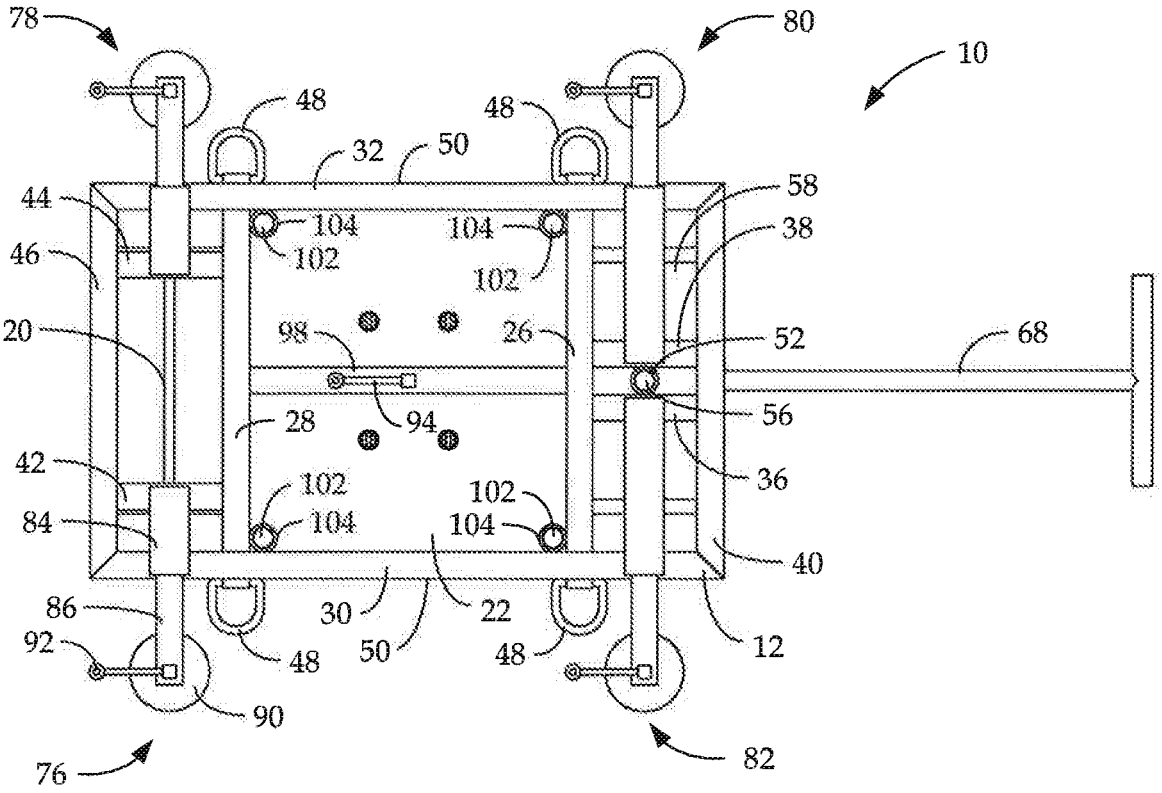
FIG. 3 is a plan view of the fall restraint system of FIG. 1.
Figure 4:
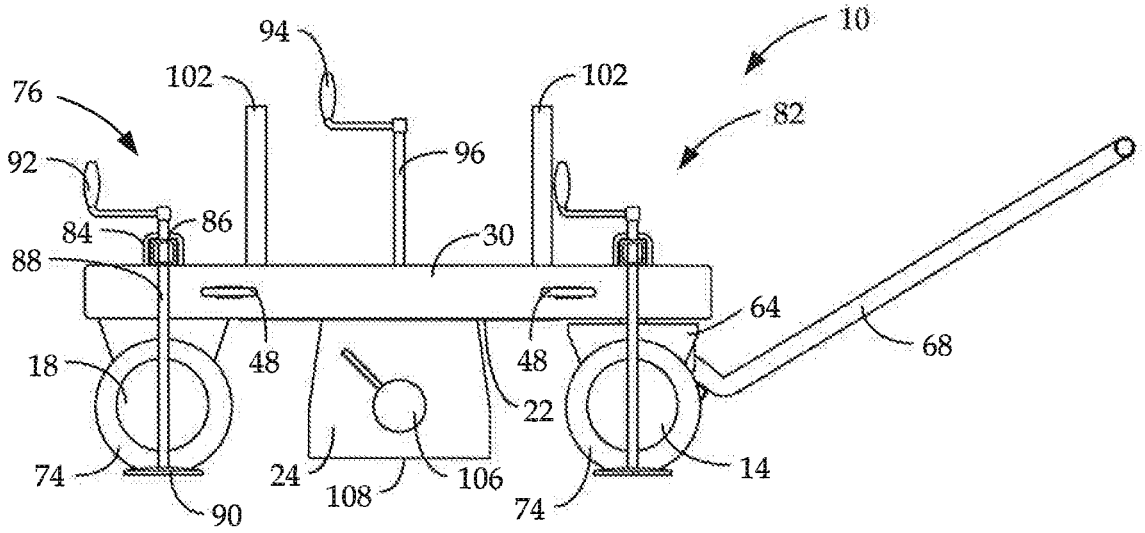
FIG. 4 is a left side elevational view of the fall restraint system of FIG. 1.
Figure 5:
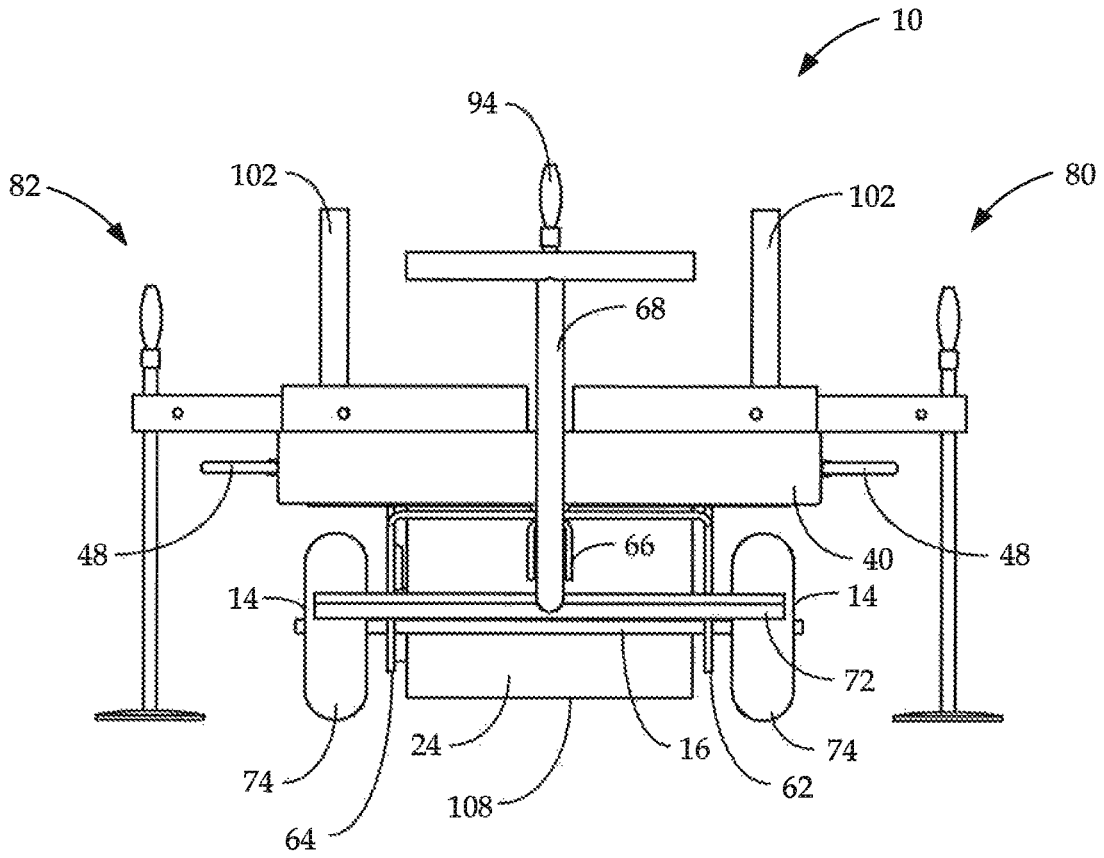
FIG. 5 is a front elevational view of the fall restraint system of FIG. 1.

Referring to FIGS. 1-5, a cart-style fall restraint apparatus of the present invention is generally indicated by reference numeral 10. Fall restraint apparatus 10 includes a frame 12, front wheels 14 mounted on a pivotable front axle 16, rear wheels 18 mounted on a fixed axle 20 and a magnet table 22 for supporting one or more magnets 24. The frame 12 includes a forward lateral crossmember 26 and a rear lateral crossmember 28, extending from opposite sides 30 and 32 of the frame 12 across an interior area 34 of the frame 12. A pair of spaced apart front longitudinal frame members 36 and 38 attach the front 40 of the frame 12 to the forward lateral crossmember 26. A pair of spaced apart rear longitudinal frame members 42 and 44 attach the back 46 of the frame 12 to the rear lateral crossmember 28. In an embodiment, the frame members are made of square steel tubing welded together to provide a sufficiently rigid and structural frame 12. Anchor points 48 are secured to the outer periphery 50 of the frame 12.

A rotational sleeve 52 is fastened or welded between and to the interior surfaces of front longitudinal frame members 36 and 38, and is coupled to a steering mechanism 54. The steering mechanism 54 includes a steering shaft 56 received in the rotational sleeve 52 and coupled to a yoke 58. The yoke 58 includes a steering bracket 60 secured to the rotational steering shaft 56 and having left and right arms 62 and 64 extending downwardly. The front axle 16 extends through apertures in the arms 62 and 64. A handle bracket 66 is coupled to the steering shaft 56. A handle 68 is coupled to the handle bracket 66 with a pin 70. A bar brake 72 is fastened to a lower surface of the handle 68. When the handle 68 is at rest, the weight of the handle 68 forces the bar brake 72 into the front tires 74 on wheels 14, preventing the cart 10 from rolling. When the handle 68 is used to pull the cart 10, the handle 68 pivots about the pin 70 upwardly and the bar brake 72 moves away from the front tires 74 to allow the cart 10 to roll. Typically the front tires 74 and rear tires 75 on wheels 18 are large rubber tires to permit relatively easy movement of the fall restraint apparatus 10 when the magnet 24 is not energized and locked to a roof.

Four outrigger assemblies 76, 78, 80 and 82 are secured to the frame 12. Each of the outrigger assemblies 76, 78, 80 and 82 are configured substantially the same, and thus only of one of the outrigger assemblies will be described in detail. Outrigger assembly 76 includes a receiver 84 coupled to side frame 30 and rear longitudinal frame member 42 adapted to receive an extendable outrigger arm 86. A threaded rod 88 engages an aperture in the free end of the extendable outrigger arm 86. A foot 90 is secured to the bottom end of the threaded rod 88 and a crank 92 is secured to the top end of the threaded rod 88. Rotation of the crank 92 clockwise and counterclockwise raises and lowers the foot 90.

Magnet 24 is bolted or otherwise fastened to the magnet table 22. A crank 94 coupled to a threaded rod 96 is coupled to a longitudinal frame member 98 through a threaded aperture 100. The longitudinal frame member 98 is secured at opposite ends to the forward 26 and rear 28 lateral crossmembers. The magnet table 22 is generally square and includes round posts 102 in each corner. The round posts 102 are received in tubular guides 104 welded in each corner of the frame formed by sides 30 and 32 and lateral crossmembers 26 and 28. As the crank 94 is rotated the magnet table 22 is raised and lowered and the posts 102 within the tubular guides 104 stabilize the magnet table 22. The magnet 24 includes a magnetic lift lever 106 to activate/deactivate the magnet 24. The magnet 24 may be a rare earth permanent magnet, such as a neodymium magnetic lift magnet, with a lift rating of 4400 pounds (2000 kilograms), for example. Other sizes/strengths may be used depending on the application.

The fall restraint apparatus 10 may be placed on a roof or other raised structure where workers are required by OSHA regulations to be tethered or otherwise restrained. The fall restraint apparatus 10 is positioned over a steel beam in the roof with the magnet 24 above the beam. The magnet 24 is lowered by turning the crank 94 until the bottom surface 108 of the magnet 24 is in contact with the surface of the roof. Shims may be used to accommodate any variance in the work surface of the roof and the height of the magnet 24.

Each of the outriggers 76, 78, 80 and 82 may be extended and the feet 90 lowered by rotating cranks 92 until the feet 90 are in contact with the roof surface. The outriggers 76, 78, 80 and 82 provide stability to the fall restraint apparatus 10. Once the fall restraint apparatus 10 is properly located on the roof, the magnetic lift lever 106 is rotated to activate the magnet 24. The magnet 24 may be a single magnet or multiple magnets, electromagnets or permanent lift magnets, for example.

Retractable lifelines may be attached to one or more of the anchor points 48 and to a worker's harness to so that the worker may safely work on the roof. In the event of a fall, the retractable lifeline gently slows the worker's fall to a stop and the fall restraint apparatus 10 provides a secure anchor to the roof structure.

When a section of a roof is complete, the magnet 24 is deenergized or otherwise released, the outriggers 76, 78, 80 and 82 raised and the fall restraint apparatus 10 moved to the next section of roof to be worked on.

It is to be understood that while certain now preferred forms of this invention have been illustrated and described, it is not limited thereto except insofar as such limitations are included in the following claims. Many different arrangements of the various components depicted, as well as components not shown, are possible without departing from the scope of the claims below. Embodiments of the invention have been described with the intent to be illustrative rather than restrictive. Alternative embodiments will become apparent to readers of this disclosure after and because of reading it. Alternative means of implementing the aforementioned may be completed without departing from the scope of the claims below. Certain features and subcombinations are of utility and may be employed without reference to other features and subcombinations and are contemplated within the scope of the claims.

Having thus described the invention, what is claimed as new and desired to be secured by Letters Patent is:

1. A fall restraint apparatus comprising:

a cart having a frame and two front wheels and two rear wheels coupled to said frame;

said frame having an outer periphery;

one or more anchor points secured to said outer periphery of said frame;

four outriggers each having an extendable arm adjustably received in a receiver secured to said frame and positionable between a stowed position and an extended position;

each of said adjustable arms having a free end supporting an adjustable rod;

each of said adjustable rods having a foot secured to a lower end of said adjustable rod and adjustable between a raised position and a lowered position engaging a roof surface;

a magnet having a lower surface and coupled to said frame;

means for adjusting a height of said magnet between a raised position and a lowered position; and means for selectively energizing and deenergizing said magnet;

wherein said magnet engages the roof surface in said lowered position and secures said cart to the roof surface when said magnet is energized;

wherein said outriggers stabilize said cart when said extendable arms are in said extended position and said adjustable rods are in said lowered position.

2. The fall restraint apparatus of claim 1 further comprising a steering mechanism coupled to said two front wheels.

3. The fall restraint apparatus of claim 2 wherein said steering mechanism includes a releasable brake selectively engaging said two front wheels.

4. The fall restraint apparatus of claim 1 wherein said magnet is an electromagnet.

5. The fall restraint apparatus of claim 1 wherein said magnet is a permanent lift magnet.

6. The fall restraint apparatus of claim 1 wherein said magnet comprises a plurality of magnets.

7. A fall restraint apparatus comprising:

a cart having a frame and two front wheels and two rear wheels coupled to said frame, and a steering mechanism coupled to said two front wheels;

said frame having an outer periphery;

one or more anchor points secured to said outer periphery of said frame;

four outriggers each having an extendable arm adjustably received in a receiver secured to said frame and positionable between a stowed position and an extended position;

each of said adjustable arms having a free end supporting an adjustable rod;

each of said adjustable rods having a foot secured to a lower end of said adjustable rod and adjustable between a raised position and a lowered position engaging a roof surface;

a magnet having a lower surface and coupled to said frame, said magnet adjustable between a raised position and a lowered position;

a crank secured to a threaded rod coupled to said frame and said magnet for lowering and raising said magnet; and means for selectively energizing and deenergizing said magnet;

wherein said magnet engages the roof surface in said lowered position and secures said cart to the roof surface when said magnet is energized;

wherein said outriggers stabilize said cart when said extendable arms are in said extended position and said adjustable rods are in said lowered position.

8. The fall restraint apparatus of claim 7 wherein said steering mechanism includes a releasable brake selectively engaging said two front wheels.

9. The fall restraint apparatus of claim 7 wherein said magnet is an electromagnet.

10. The fall restraint apparatus of claim 7 wherein said magnet is a permanent lift magnet.

11. The fall restraint apparatus of claim 7 wherein said magnet comprises a plurality of magnets.

12. A fall restraint apparatus comprising:

a cart having a rectangular frame, two front wheels and two rear wheels coupled to said frame, and a steering mechanism coupled to said two front wheels;

said rectangular frame having an outer periphery and longitudinal sides;

four anchor points secured to said longitudinal sides of said outer periphery of said frame at opposite ends;

four outriggers each having an extendable arm adjustably received in a receiver secured to said frame at each of said opposite ends of said longitudinal sides and positionable between a stowed position and an extended position;

each of said adjustable arms having a free end supporting an adjustable rod;

each of said adjustable rods having a foot secured to a lower end of said adjustable rod and adjustable between a raised position and a lowered position engaging a roof surface;

a magnet having a lower surface and coupled to said frame, said magnet adjustable between a raised position and a lowered position;

a crank secured to a threaded rod coupled to said frame and said magnet for lowering and raising said magnet; and means for selectively energizing and deenergizing said magnet;

wherein said magnet engages the roof surface in said lowered position and secures said cart to the roof surface when said magnet is energized;

wherein said outriggers stabilize said cart when said extendable arms are in said extended position and said adjustable rods are in said lowered position.

13. The fall restraint apparatus of claim 12 wherein said steering mechanism includes a releasable brake selectively engaging said two front wheels.

14. The fall restraint apparatus of claim 12 wherein said four outriggers are laterally adjustable.

15. The fall restraint apparatus of claim 12 wherein said magnet is an electromagnet.

16. The fall restraint apparatus of claim 12 wherein said magnet is a permanent lift magnet.

* * * * *